US006903290B2

(12) United States Patent
Coppola

(10) Patent No.: US 6,903,290 B2
(45) Date of Patent: Jun. 7, 2005

(54) SAFETY SWITCH

(75) Inventor: Antonio Coppola, Turate (IT)

(73) Assignee: Signal Lux MDS S.r.l, Milan (IT)

( * ) Notice: Subject to any disclaimer, the term of this patent is extended or adjusted under 35 U.S.C. 154(b) by 0 days.

(21) Appl. No.: 10/716,486

(22) Filed: Nov. 20, 2003

(65) Prior Publication Data

US 2004/0168896 A1 Sep. 2, 2004

(30) Foreign Application Priority Data

Feb. 28, 2003 (EP) ..... 03425136

(51) Int. Cl.[7] ..... H01H 13/14
(52) U.S. Cl. ..... 200/334; 200/339; 200/553
(58) Field of Search ..... 200/334, 336, 200/339, 6 R, 6 B, 6 C, 6 BA, 276–277.2, 553, 557, 562

(56) References Cited

U.S. PATENT DOCUMENTS 5,304,753 A 4/1994 Parrish et al. ..... 200/16 B
5,495,081 A * 2/1996 Ipcinski ..... 200/341
5,767,465 A * 6/1998 Fulton et al. ..... 200/16 R
6,028,274 A * 2/2000 Harris ..... 200/52 R

FOREIGN PATENT DOCUMENTS

| | | |
|---|---|---|
| DE | 12 56 763 B | 12/1967 |
| FR | 2298176 | 8/1976 |
| GB | 1168567 | 10/1969 |

* cited by examiner

*Primary Examiner*—Lincoln Donovan
*Assistant Examiner*—M. Fishman
(74) *Attorney, Agent, or Firm*—Arent Fox, PLLC

(57) ABSTRACT

A safety switch includes an activation key housed in a casing, a pair of contact-holding elements, and a triad of electric terminals. The contact-holding elements oscillate between a passive position and an active position, the positions being imposed by a corresponding position of the activation key. The contact-holding elements are mutually electrically connected through conductive elements that, when operation of the switch takes place in a condition of failure, can move with respect to one another for relative displacement of mating surfaces to determine a loss of contact between the contact-holding elements.

14 Claims, 6 Drawing Sheets

SAFETY SWITCH

FIELD AND BACKGROUND OF THE INVENTION

The present invention relates to an electric safety switch and more particularly to a pressure switch for electric motors of apparatus and vehicles stopping of which must be ensured under any condition, even in case of blocking of the switch itself.

Switches of this type are already known in the art: U.S. Pat. No. 5,304,753 for example depicts a safety press switch of the mentioned type.

Said switch comprises a contact-holding slide which is slidable under the thrust of an activation button receiving current from a terminal which is always alive and transmits said current to the terminal of an electric motor or alternatively to the terminal of a braking device. More specifically, when the button is in a rest condition the slide powers the brake terminal while the motor terminal is disconnected, and the opposite occurs when the button is in a work condition. A counter-spring bucks displacement of the button keeping it normally in a rest condition. The slide consists of two parts electrically in contact with one another but susceptible of mechanical separation: the slide, during its stroke, opens the contact with the brake terminal and, on reaching its end of stroke, closes the contact with the motor.

It may happen that repeated opening and closing cycles of the motor contact cause the switch to get blocked by welding between the contact point on the slide and the contact point on the terminal, due to the electric arc created between said points at each opening and closing movement of the contact.

Without an appropriate safety device, this drawback, since the motor is maintained always powered, constitutes a great risk for the safety of the operator assigned to the machine or for the vehicle driver and also for the safety of the apparatus itself.

In the switch of the described type safety consists in that, in case of welding between the contact points of the motor contact, when pressure on the activation button is released, the two slide parts separate under the thrust of the counter-spring, thereby breaking the electric contact between the portion welded to the motor terminal and the portion always alive. The slide portion coming back to the rest position restores the electric contact with the, brake terminal and blocks the kinematic motion of all movable parts, preventing any reuse of the switch.

In a different type of switch the circuit for powering the motor terminal contemplates two contact points placed on either side of the slide and disposed at a mutual distance along the stroke of the slide: the slide during its stroke first closes a first contact on which no sparking occurs because the motor terminal is still disconnected, and subsequently closes a second contact of true connection with the motor. In case of welding between the contacts, said welding only takes place on the second contact: on occurrence of said welding the slide, during its return stroke, tilts relative to its normal movement axis because it is retained on the side where the second welded contact is present and free on, the opposite side where the first contact is present, which first contact opens without difficulty interrupting power supply to the motor. However, this inclination of the slide causes blocking of the kinematic motion of the movable parts making the switch unusable.

All these switches have serious limits and drawbacks.

A first drawback arises from the fact that this type of safety asks for a very long stroke of the activation button and the slide and this constitutes an annoying dimensional bulkiness and a factor of mechanical weakness of the switch.

A different drawback resides in that this type of structure needs structurally weak components from an electric point of view as well, since the components must maintain reduced physical sizes in order not to have a switch which is too bulky and heavy.

Another drawback is due to the fact that these switches do not contemplate the presence of any protection device against a too prolonged continuous use of same. As a consequence, the switch that badly withstands overheating due to such a use, is often subjected to failure with or without occurrence of welding of the contact points on the terminals and it does not even protect the motor from the consequences of such a use, involving economic charges for servicing, repair and replacement of damaged parts in the apparatus.

Now the Applicant has become aware of the fact that the listed problems could be solved with a switch of a new type capable of simultaneously ensuring full safety, functional qualities, reliability and low cost. In particular, the Applicant has sensed that a solution could be found in a particular combination between the switch architecture, the position of the contacts and the features of the employed materials.

SUMMARY OF THE INVENTION

Accordingly, the invention relates to a safety switch, in particular for motor circuits of manufacturing machines and electric vehicles in which said contact-holding elements are mutually electrically connected through conductive elements that are movable with respect to one another by relative displacement of mating surfaces in mutual contact.

BRIEF DESCRIPTION OF THE DRAWINGS

Further features and advantages of the invention will become more apparent from the detailed description of a preferred but not exclusive embodiment of a switch in accordance with the present invention. This description will be set out hereinafter with reference to the accompanying drawings, given by way of non limiting example, in which.

DESCRIPTION OF THE PREFERRED EMBODIMENT

Figure 1:
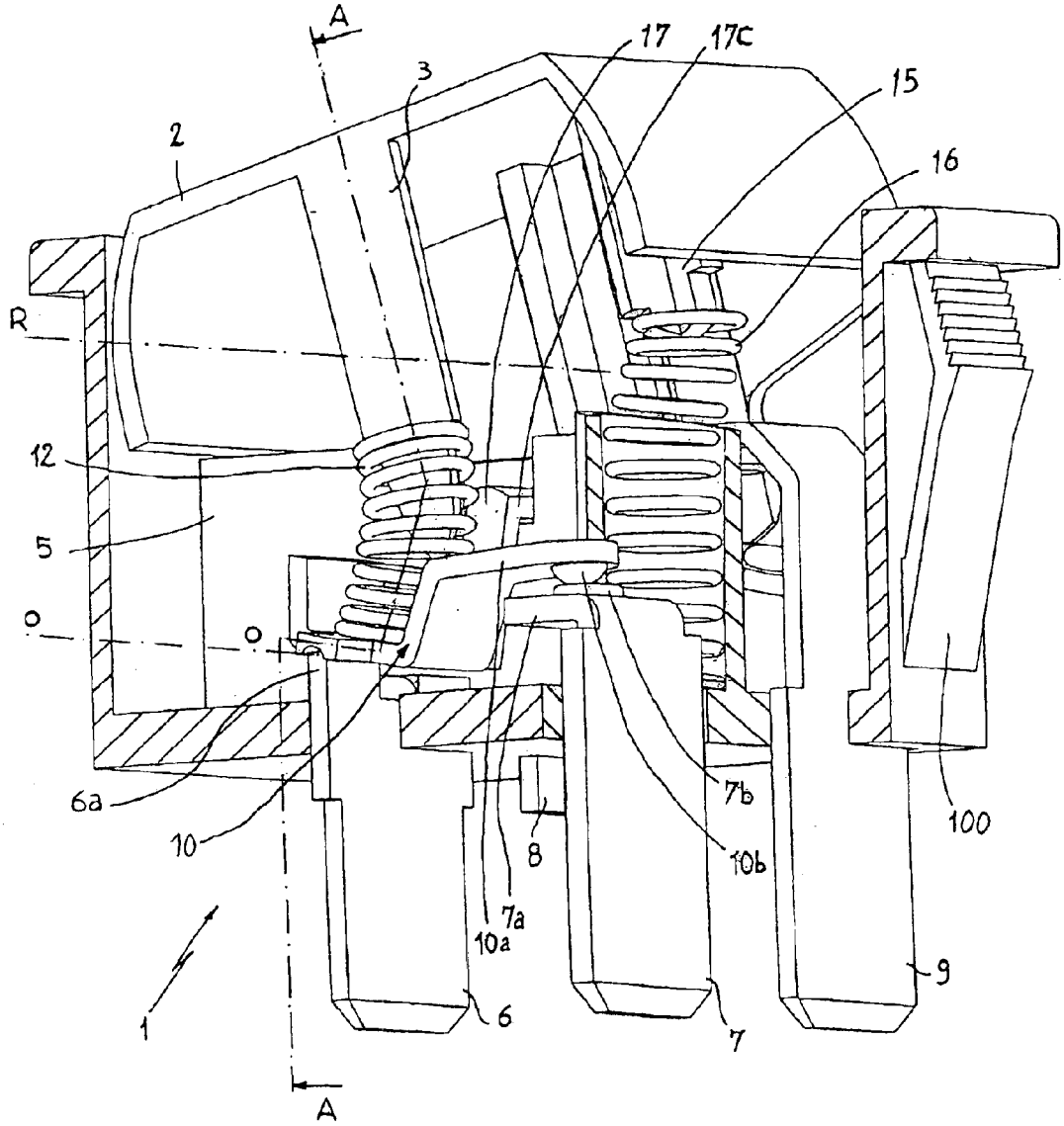
FIG. 1 is a perspective front view, partly in section, of a switch in accordance with the invention in a passive position, seen from the left.
Figure 2:
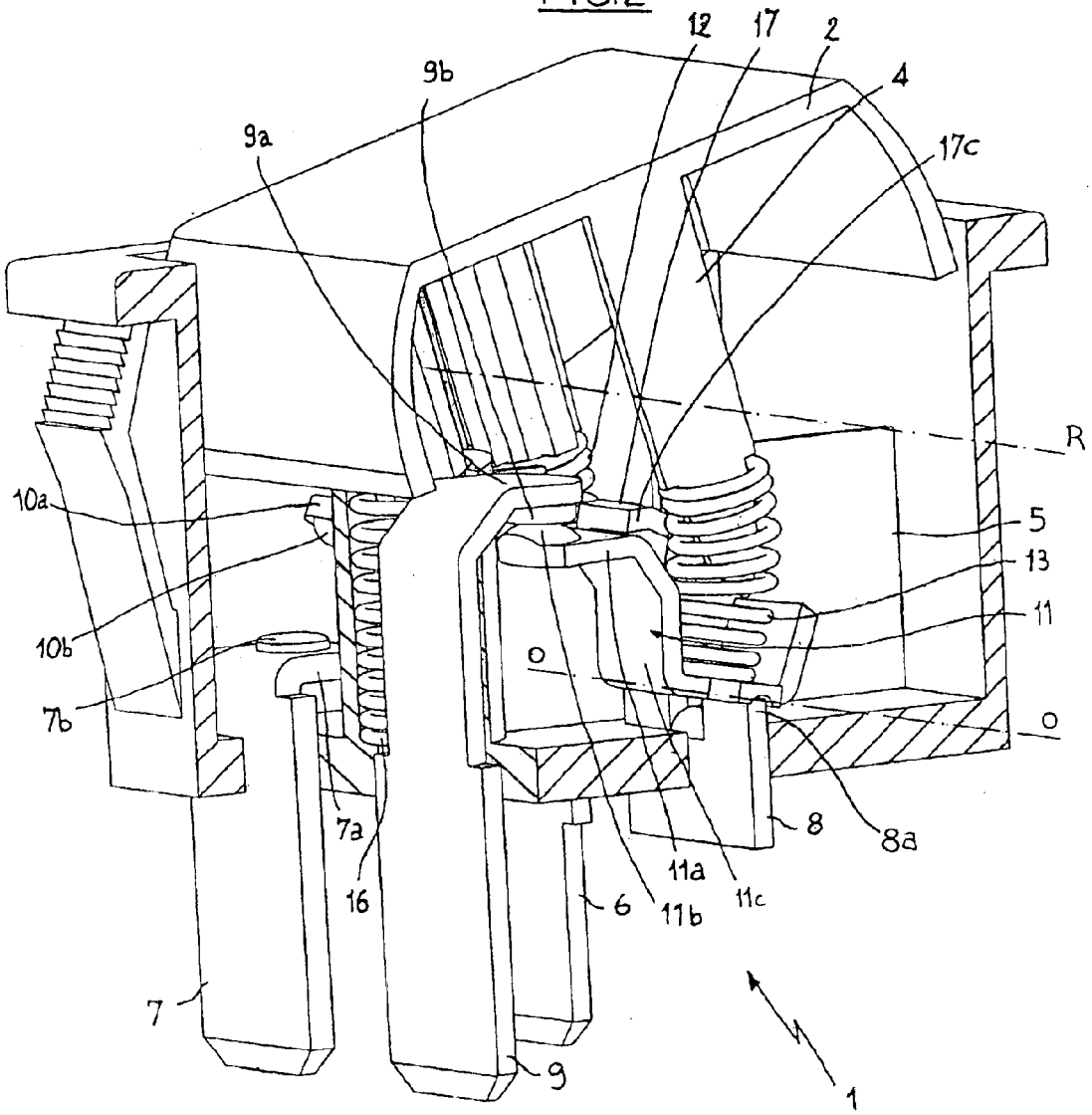
FIG. 2 is a perspective front view of the switch in FIG. 1, in an active position, seen from the right.

In its most general form, the safety switch of the invention comprises a casing 1 inside which it is housed an activation key 2, a pair of contact-holding elements, identified as first 10 and second 11 elements respectively, and a triad of electric terminals 6, 7, 9, identified as central 6, first 7 and second 9 terminals respectively, emerging from the floor of said casing 1 on both sides thereof; these contact-holding elements 10, 11 oscillate around the same oscillation axis O—O between two positions that will be identified as a passive position and an active position, respectively. Each contact-holding element 10, 11 is disposed in a tilting manner around an end of a corresponding laminar support, identified as first 6*a* and second 8*a* laminar supports respectively, and each of said positions is fixed by a corresponding position of said activation key 2 pivoting about a rotation axis R—R parallel to the oscillation axis O—O. The central terminal 6 of the triad 6, 7, 9 is in permanent electric contact with one of the contact-holding elements 10, 11, whereas the two other terminals, first 7 and second 9 terminals respectively, are each alternately separated from or in electric contact with the corresponding first and second contact-holding elements 10, 11 depending on the position of key 2; the contact-holding element 10, 11 closed on the corresponding terminal 7, 9 in a passive position is separated from the latter in an active position and vice versa. The contact-holding elements 10, 11 are electrically connected to each other through two conductive elements 17, 18 each of which is associated with its corresponding contact-holding element and they are capable of being separated from each other by relative displacement of mating surfaces 17*a*, 18*a* in mutual contact during normal use.

In more detail, the safety switch of the invention comprises an open casing 1 of insulating material, preferably a plastic material, inside which a T-shaped key 2 is housed in a manner known by itself, which key rotates in a longitudinal direction in either way around a transverse rotation axis R—R disposed in the "T" foot. Extending from the casing floor, within the casing 1 itself, there is a separation baffle 5, radially projecting outwardly and dividing said casing into two longitudinal cavities identified as first and second cavities respectively; in the following the elements belonging to one of the cavities will be also identified with the adjective (first and second) relating to the corresponding cavity.

In the present description the term "longitudinal direction" means the rotation direction of key 2, "transverse direction" means the direction of axis R—R around which rotation of key 2 takes place, "radial direction" the one perpendicular to the plane containing said longitudinal and transverse directions.

Casing 1 is preferably provided on its outer side surface, with devices 100 enabling easy mounting of the casing itself, by forced fitting for example, in the apparatus for which it is intended. Key 2 comprises a surface turned towards the outside of casing 1 which is laterally provided with two opposite arms 3 and 4 radially extending inwardly of the casing, one for each cavity, and substantially embodying the "T" leg.

A triad of electric terminals 6, 7, 9, is inserted in the floor of casing 1 for connection with the circuits to be controlled; preferably said electric terminals 6, 7, 9 are shaped as three plate-like lugs 6, 7, 9 of electrically conductive material projecting from said floor and facing said key 2. Also projecting from the floor is a further plate-like lug 8 preferably of insulating material, and also facing said key.

The first and third plate-like lugs 6 and 7 are inserted in the first cavity of the casing, the second and fourth plate-like lugs 8 and 9 are inserted in the second cavity disposed in side by side relationship with the first cavity. Preferably, the first plate-like lug 6 and second plate-like lug 8 are in alignment with each other in a transverse direction and lie in the plane containing the rotation axis R—R.

Preferably, at least the first, third and fourth plate-like lugs 6, 7 and 9 project from the floor of casing 1 also outwardly.

The first and the second plate-like lugs 6 and 8 define the laminar support 6*a*, 8*a* for a pair of contact-holding elements 10, 11; more preferably, each end of the first and the second plate-like lugs 6 and 8 projecting inwardly of the container acts as a fulcrum for a corresponding contact-holding element 10, 11 oscillating around said fulcrum along a transverse oscillation axis O—O parallel to axis R—R.

Preferably each contact-holding element 10, 11 comprises a pilot member 10*c*, 11*c* having a U-shaped conformation, the base of which rests on the corresponding fulcrum and at least one of the sides of which is provided with a flange 10*a*, 11*a* on the free end thereof. Preferably, the flange projects in cantilevered fashion from said end and extends lengthwise, away from the oscillation axis. Fastened to this flange is an electric contact point 10*b*, 11*b* preferably consisting of a droplet of appropriate conductive material welded to the surface of said flange.

In more detail, contact point 10*b* is fastened to the flange surface 10*a* facing the floor, contact point 11*b* is fastened to the flange surface 11*a* facing the key 2.

The third and fourth plate-like lugs 7 and 9 project inwardly of the casing at flanges 10*a* and 11*a*, respectively: preferably, the free end of each third and fourth plate-like lug is provided with a flange 7*a*, 9*a* projecting in cantilevered fashion from said end and extended in a longitudinal direction towards the oscillation axis O—O. Fastened to each flange 7*a*, 9*a* is an electric contact point 7*b*, 9*b* preferably consisting of a droplet of appropriate conductive material welded to the flange surface. In more detail, contact point 7*b* is fastened to the surface of flange 7*a* facing key 2, contact point 9*b* is fastened to the surface of flange 9*a* facing the floor. The radial extension (height) of said third and fourth plate-like lugs 7 and 9 is different; the third plate-like lug 7 has flange 7*a* disposed between the flange 10*a* and the casing floor, the fourth plate-like lug 9 has flange 9*a* disposed between flange 11*a* and key 2. In this way the contact points 10*b* and 7*b*, 11*b* and 9*b* always face each other in mutual correspondence.

Resting on the surface of the "U" base, i.e. the contact-holding pilot member 10*c*, 11*c* facing key 2, is the end of a helical spring 12, 13 the opposite end of which is fitted on the end of an arm 3, 4 of key 2, in abutment against a locking relief. Preferably, the end of spring 12, 13 resting on the base of the pilot member 10*c*, 11*c* is maintained in place by a relief 14 in the form of a spherical cap radially projecting outwardly from said base.

The length of springs 12 and 13 is slightly greater than the distance between the abutment of arm 3, 4 and the base of the pilot member 10*c*, 11*c*, so that the springs are compressed and in an unstable equilibrium thereby taking a curvilinear trajectory; the resulting thrust exerted by each spring 12, 13 onto the corresponding pilot member 10*c*, 11*c* forces the pilot member itself to a predetermined position relative to the longitudinal direction.

In the longitudinal axial plane of key 2, linked to the radially internal surface of the key, there is a third arm 15 extending radially inwardly; the free end of this arm 15 is introduced into a third helical spring 16, in abutment against a locking relief, which spring has its opposite end housed within a cylindrical seat 16*a* protruding radially outwardly from the floor of casing 1. This seat keeps spring 16 working in compression in a substantially rectilinear configuration.

Spring 16 which is compressed when key 2 is in its active position, supplies the required energy to overcome the resistance of springs 12 and 13 when the key is to be brought back to its passive position.

In accordance with the invention, the two pilot members 10*c*, 11 *c* are electrically connected to one another through conductive elements 17, 18 movable with respect to one another by the relative displacement of mating surfaces 17*a*, 18*a* in mutual contact relationship.

Figure 4:
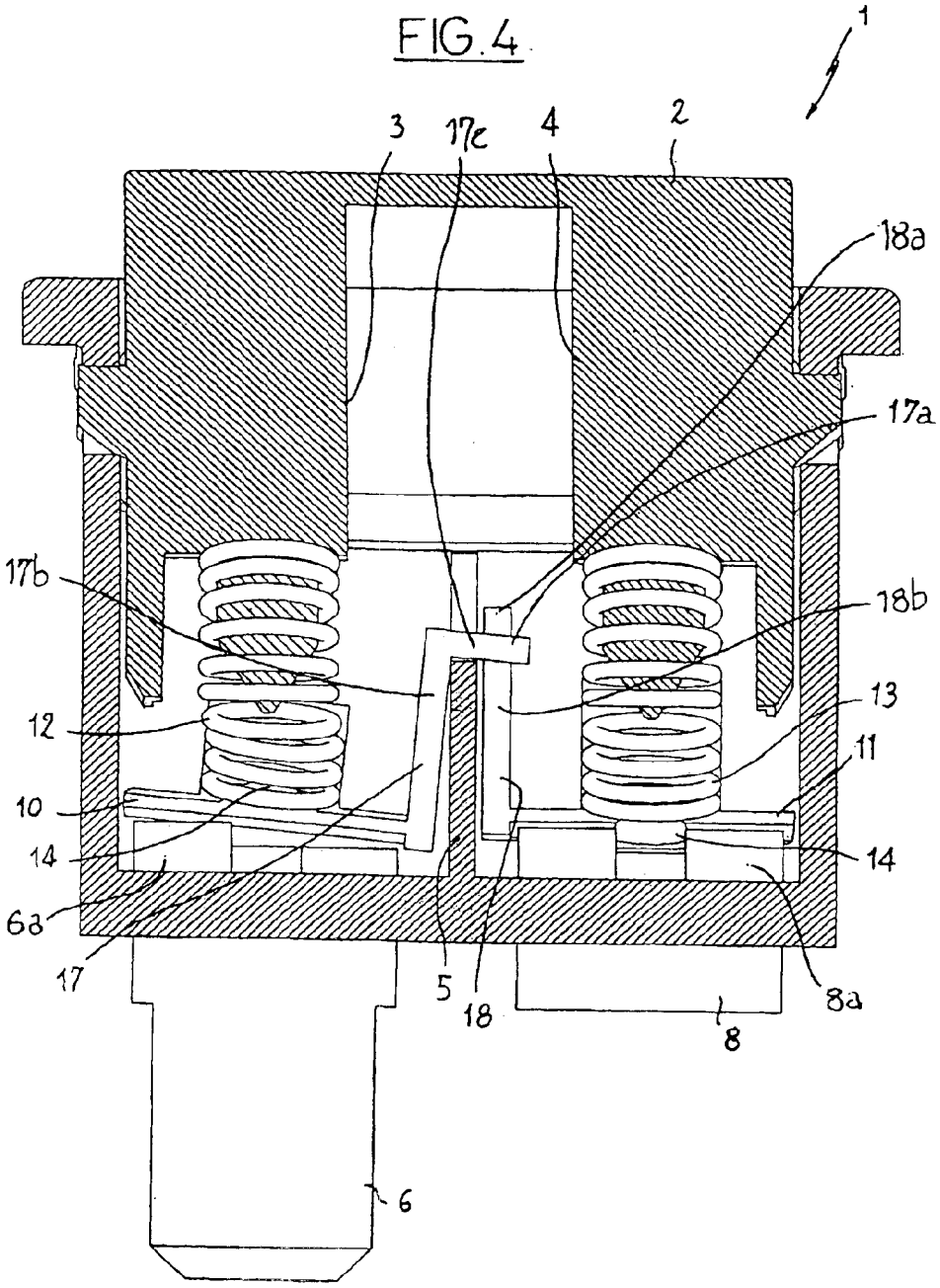
FIG. 4 is a sectional view of the switch in FIG. 1 taken along a transverse line II—II in FIG. 1, after the opening step, in a condition of failure.

In a preferred embodiment of the invention, the conductive elements 17, 18 are L-shaped plates and the base of each pilot member 10*c*, 11*c* is integral with an L-shaped plate 17, 18, respectively, radially extending outwardly (FIG. 4). More preferably, the long leg 17*b*, 18*b* of the "L" is fastened to the base of the pilot member 10*c*, 11*c* along the edge facing the adjacent pilot member, and the short leg of the "L", hereinafter referred to as "slid" 17*b*, 18*c* projects in cantilevered fashion in a transverse direction from the free end of the long leg and faces the adjacent pilot member 10*c*, 11*c* as well. The two slides 17*c*. 18*c* carry the mating surfaces 17*a*, 18*a* and are preferably formed with a curvilinear or dihedral surface the concavity of which is turned towards the oscillation axis O—O, preferably with the dihedron edge parallel to said oscillation axis. The shapes of the two surfaces match one another and are in mutual forced contact, the slide 17*c* of the pilot member 10*c* being radially superposed on the slide 18*c* of the pilot member 11*c*.

The pilot member 11*c* is supported over the whole width thereof, in a transverse direction, by the second plate-like lug 8, whereas the pilot member 10*c* is supported in the same transverse direction over only half its width from the first plate-like lug 6 which on its center line is provided with a step facing the pilot member 11*c*.

In conclusion, the pilot member 10*c* is respectively supported, at two transversely opposite positions, by the portion of the first plate-like lug 6 constituting the fulcrum of the pilot member and by the slide 17*c* resting on the adjacent slide 18*c*.

The dividing baffle 5 has a recess extending radially outwardly at the position taken by the pilot members 10*c*, 11*c* when the switch is in its passive position.

The first, third and fourth plate-like lugs 6, 7 and 9, as previously said, preferably project to the outside of casing 1 emerging from the floor of the casing itself: these projecting portions, in use, are connected to corresponding lead-in wires of the conductors of the electric installation to be controlled; more specifically, the first plate-like lug 6 defining the central terminal is connected to the supply voltage and is always energized, the plate-like lug 7 defining the first terminal is connected to a braking device of the apparatus, the plate-like lug 9 defining the second terminal is connected to the motor device of the apparatus. It should be pointed out that the second laminar support 8*a* of the second pilot member 11 is not directly connected with the electric circuit controlled by the switch; the material of the plate-like lug 8 can therefore be any suitable material, not necessarily an electrically conductive material. Still to be pointed out is the fact that the electric connection between the two pilot members 10*c* and 11*c* is made by the conductive elements 17 and 18.

FIG. 1 shows the switch of the invention in a first position herein defined as passive position. In this position the flanges 10*a*, 11*a* of the pilot members 10*c*, 11*c* are inclined to the floor of casing 1: the contact between the pilot member 10*c* and the third plate-like lug 7 is closed, the contact between the pilot member 11*c* and the fourth plate-like lug 9 is open.

A pressure exercised on the radially external surface of key 2, alternately in the two end positions, rotates the key around the transverse rotation axis R—R substantially passing by the two side arms 3, 4 of key 2, close to the end of the corresponding springs 12, 13.

Said rotation of key 2 changes the inclination of arms 3, 4 and therefore reverses bending of springs 12, 13, fitted between the arm and the pilot member 10*c*, 11*c*, towards the longitudinally opposite direction: consequently, each spring 12, 13 forces the corresponding pilot member 10*c*, 11*c* to longitudinally swing on its fulcrum, causing inclination of flange 10*a*, 11*a* towards key 2. By effect of this change of inclination the switch takes a position identified as active position, opening the contact between the pilot member 10*c* and the third plate-like lug 7, while closing that between the pilot member 11*c* and the fourth plate-like lug 9.

Operation of the switch takes place as follows. It is assumed that the switch must control an electric circuit, not shown, containing a motor device and a braking device, to be operated separately, through the third plate-like lug 7 powering the braking circuit and the fourth plate-like lug 9 powering the motor circuit, and it is also assumed that the switch is in a passive position i.e. is powering the braking circuit. The first plate-like lug 6 is connected with the main voltage energizing the pilot member 10*c* as well. The braking system is powered by the third plate-like lug 7 in electric connection with the pilot member 10*c* through the pair of contact points 10*b* and 7*b*. The pilot member 11*c* is energized as well, through the pair of slides 17*c* and 18*c*, but the flange 11*a* and fourth plate-like lug 9 are separated and therefore the motor circuit is not powered.

The motor circuit is now required to be powered: by exerting pressure on the end of key 2 which is raised with respect to casing 1, rotation of the key is caused and, with this rotation, oscillation of each pilot member 10*c*, 11*c* around the respective fulcrum occurs.

This oscillation reverses the inclination of the pilot members 10*c*, 11*c* relative to the oscillation axis O—O. The contact points 10*b* and 7*b* are separated so that the braking circuit is no longer energized and the contact points 11*b* and 9*b* are brought into mutual contact and the motor circuit is powered.

It is now assumed that for any accidental reason, due for example to sparking caused by the repeated opening and closing movements, contact points 11*b* and 9*b* remain welded to one another thereby blocking the pilot member 11*c* in the condition at which powering of the motor circuit occurs.

Figure 3:
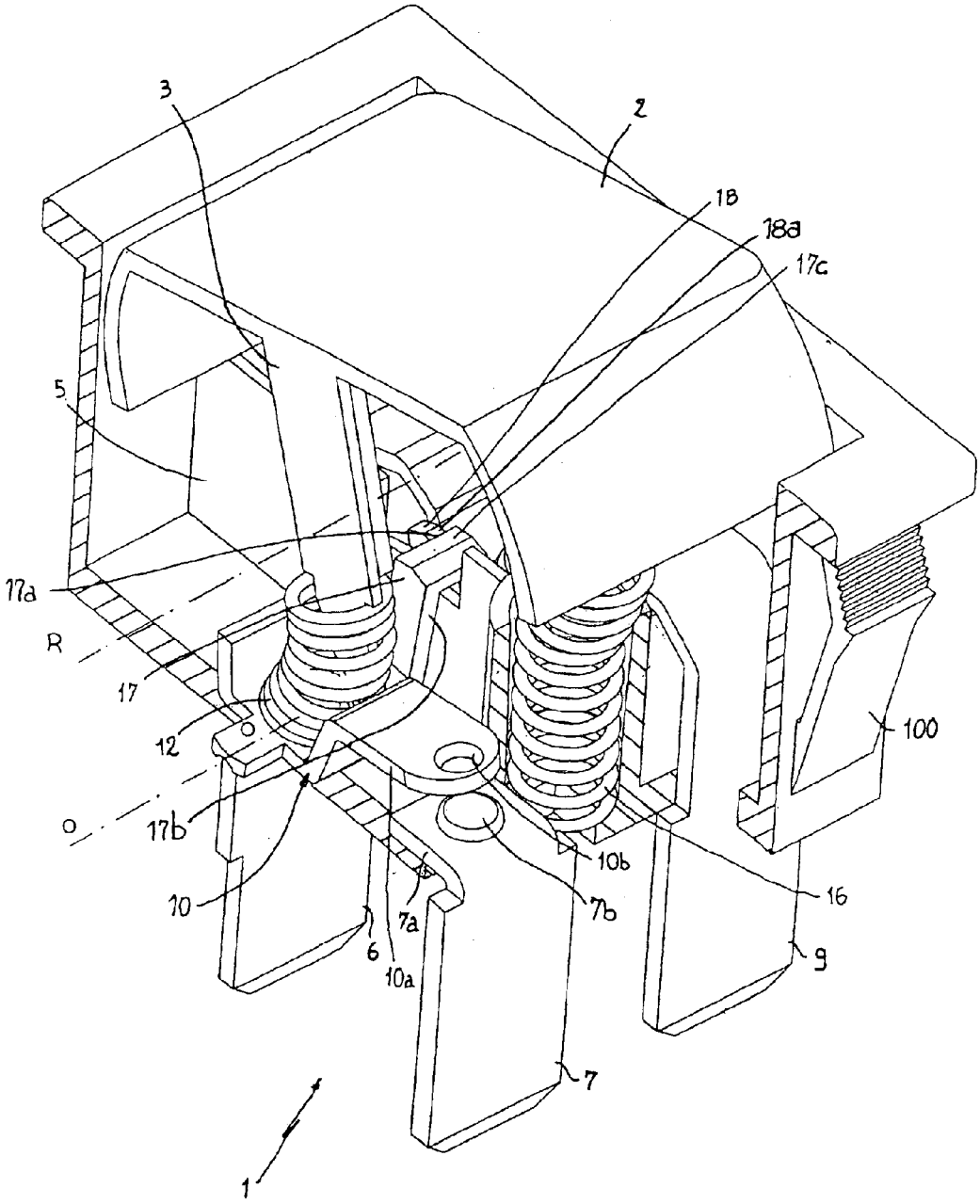
FIG. 3 is a front view from the left of the switch in FIG. 1 during the opening step in a condition of failure.

In this case, pressure exerted on the rear portion of key 2 (FIG. 3) will succeed in causing oscillation of the pilot member 10*c* alone, bringing contact points 10*b* and 7*b* to the position of mutual contact that will result in power supply being restored to the braking circuit, at the end of the oscillation.

Figure 5:
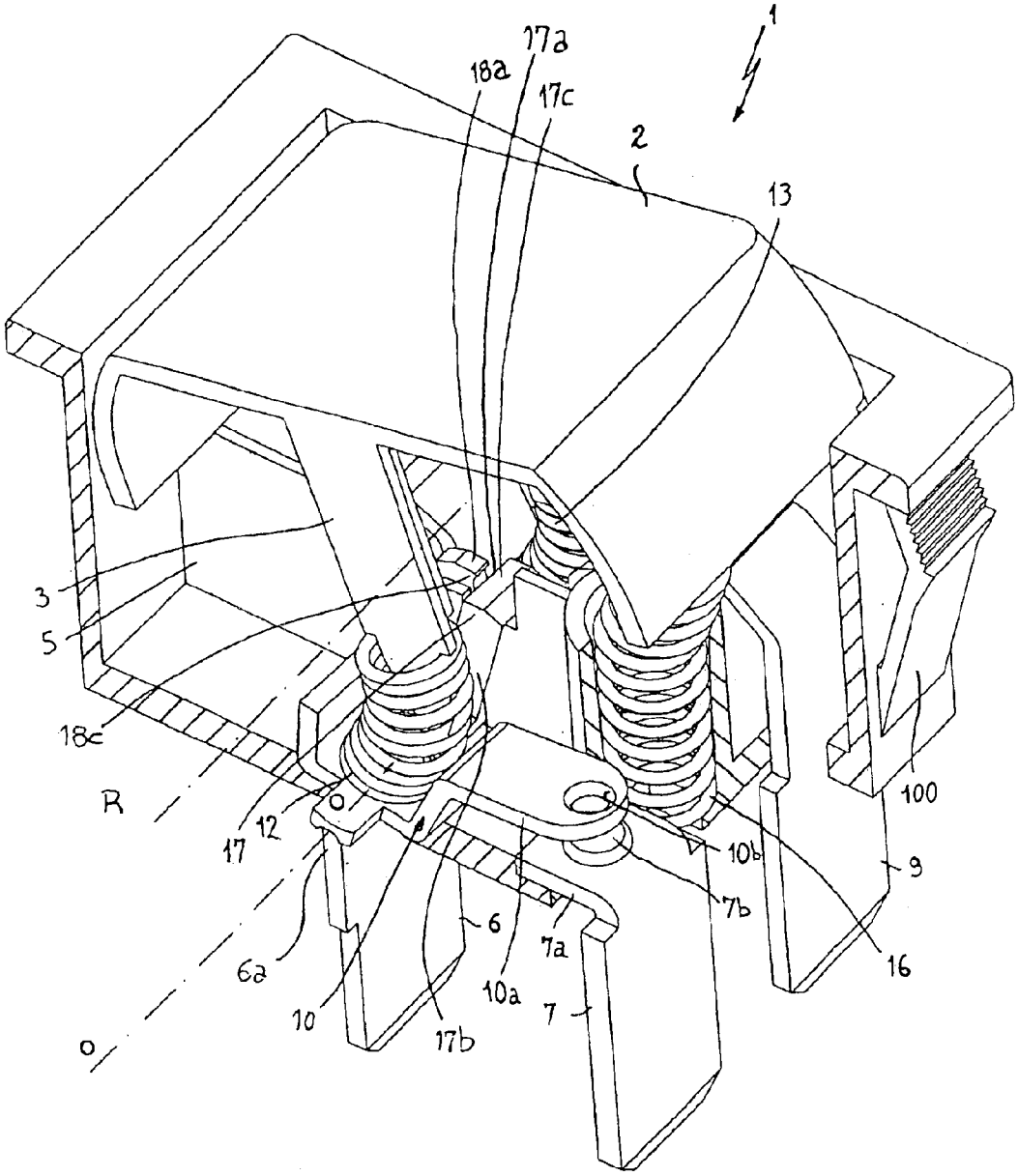
FIG. 5 is a perspective front view from the left of the switch in FIG. 1 at the end of the opening step, after a failure.
Figure 6:
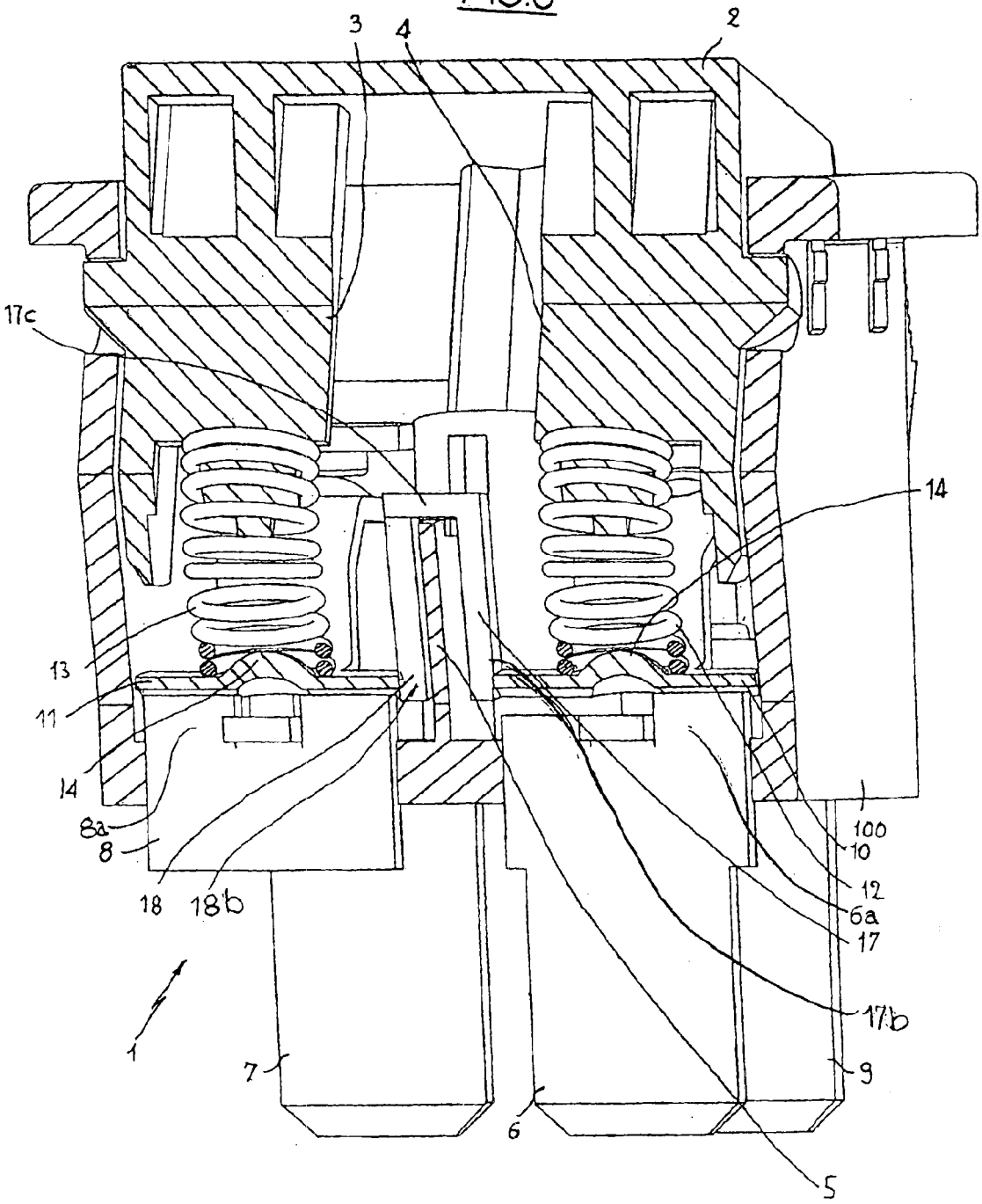
FIG. 6 is a perspective front view of the switch in FIG. 1 under normal working conditions.

Following this oscillation of the pilot member 10*c* the corresponding slide 17*c* smoothly moves along the radially external surface of the underlying slide 18*c* until the mutual contact is lost. In this way, however, slide 17*c* loses its support and consequently the pilot member 10*c* only supported close to the outer centre line of its base and submitted to the pressure of spring 12, falls (FIGS. 4 and 5) towards the dividing baffle 5 while the slide 18*c* is positioned within the recess of said baffle.

Contact loss between the two slides 17*c*, 18*c* de-energizes the pilot members 10*c*, 11*c* and therefore the motor circuit is no longer powered.

It will be understood that now the safety switch is blocked: in fact, a pressure on the front portion of key 2 does not succeed in producing the reverse oscillation of the pilot member 10*c* because the recess of the dividing baffle 5 blocks slide 17*c* inside it, inhibiting any further movement.

Insertion of slide 17*c* in the recess of baffle 5 prevents said slide from accidentally coming into contact with slide 18*c*, due to movements or vibrations of the apparatus on which the switch is mounted, for example.

For restoring operation of the apparatus, replacement of the blocked switch with a new switch is inevitably required.

However, the low cost of the switch makes repairing the switch economically unsuitable.

Taking now into account the second plate-like lug 8, it has been already seen that it can be made of a non conductive material, too. Preferably, in accordance with the invention, the second plate-like lug 8 is made of a plastic material having a low melting point.

An embodiment of the present invention enables accomplishment of another safety device associated with the just described switch. Operation of the motor in a continuous manner above all with the maximum current absorption, may cause overheating of the motor and/or the elements associated therewith with possible occurrence of drawbacks and damages. An equipment failure too (short-circuit) gives rise to a current absorption of much higher intensity than the maximum intensity allowed thereby jeopardizing safety of the associated devices.

The invention remedies these problems by making the second plate-like lug 8 of fusible material. In fact, overheating due to a failure or to an improper use also concerns the pilot members 10*c*, 11*c* the temperature of which is increased during operation. This temperature increase does not affect the first plate-like lug 6, which is made of metal as well, but can lead the second plate-like lug 8 to fusion. As a consequence of this fusion, the pilot member 11*c* falls on the floor of casing 1 losing its contact with the flange 9*a* and therefore losing its possibility of oscillating. Subsequent pressures of key 2 can only cause smooth moving of the pilot member 11*c* along the floor of the second cavity but cannot restore the lost electric connection.

A person skilled in the art will be able to conveniently select the sizes, in particular thickness, of the pilot member 11*c* and of the second plate-like lug 8, together with the type of the material to be used, in order to regulate the time and temperature values causing fusion of the second plate-like lug 8.

The invention has many important advantages.

A long directional stroke of the actuating key is not required for the switch; the key rotates about an axis remaining fixed relative to the casing body so that the key stroke is limited to the lifting amount of the key ends relative to the casing surface, following said rotation. Therefore the switch on the whole is of reduced sizes, more compact and more solid. This in spite of the fact that the movable and fixed elements of the electrically conductive portion are bigger than the corresponding elements in the known art; in particular, the contact points have larger sizes and are made of a material suitable for the purpose, so that they withstand values of current intensity much higher than the switches normally used in this type of service. These features minimize the possibility of failures for the switch of the invention and prolong duration of same.

In case of failure, both voltage maintenance on a specific lead-in wire and absence of voltage on a different specific lead-in wire is ensured; this electric configuration keeps unchanged even in case of shakes, vibrations and other movements produced on the switch.

Ultimately, the switch of the invention mostly comprises mechanical elements already used in the known art for large-use switches and therefore it is cheaper than the safety switches already known, the above mentioned defects typical of the latter being also avoided.

In the present specification all possible structural and kinematic alternative forms to the specifically described embodiments of the invention have not been illustrated. All parts herein described as conductive parts can be made of a non-conductive material for example, and made conductive by deposition or insertion of tracks of conductive material in the body of said parts.

However all these variant forms are intended to be also included within the protection scope of the present invention, as they can be easily envisaged from the description herein made of the relationship existing between each embodiment and the result that the invention wishes to achieve.

What is claimed is:

1. A safety switch for motor circuits of manufacturing machines and electric motors, comprising a casing (1) an activation key housed within the casing (2), a pair of respective first and second contact-holding elements (10, 11), and a triad consisting of a central (6), a first (7) and a second (9) electric terminals emerging from said casing, said contact-holding elements (10, 11) being oscillated about an oscillation axis (O—O) between two positions, a passive position and an active position respectively, each contact-holding element (10, 11) being disposed in a tilting manner around an end of a corresponding, respectively first and second, laminar support (6*a*, 8*a*), each of said positions being imposed by a corresponding position of said activation key (2) rotating around a rotation axis (R—R) parallel to said oscillation axis (O—O), the central terminal (6) of said triad being in permanent electric contact with one (10) of said contact-holding elements (10, 11), said first (7) and second (9) terminals being each alternately separated or in electric contact with the corresponding first and second contact-holding element (10, 11) depending on the position of said key (2), the contact-holding element (10, 11) being closed upon the corresponding terminal (7, 9) in a passive position and separated therefrom in an active position and vice versa, wherein said contact-holding elements (10, 11) are mutually electrically connected through conductive elements that are movable with respect to one another by relative displacement of mating surfaces (17*a*, 18*a*) in mutual contact.

2. The safety switch as claimed in claim 1, wherein said first and second laminar supports (6*a*, 8*a*) and said oscillation axis (O—O) and rotation axis (R—R), respectively, lie in the same plane.

3. The safety switch as claimed in claim 1, wherein said central electric terminal (6) defines said first laminar support (6*a*).

4. The safety switch as claimed in claim 1, wherein each contact-holding element (10, 11) is integral with its respective conductive element (17, 18).

5. The safety switch as claimed in claim 1, wherein said first contact-holding element (10) is supported at one end by said central terminal (6) and at the opposite end by its conductive element (17) in turn supported by the corresponding conductive element (18) of said second contact-holding element (11).

6. The safety switch as claimed in claim 1, wherein said first contact-holding element (10) when devoid of the support of said second contact-holding element (11) has its conductive element (17) in a permanent position of non-interference with said second conductive element (18).

7. The safety switch as claimed in claim 1, wherein said mating surfaces (17*a*, 18*a*) are mutually movable in the same oscillation direction as said contact-holding elements (10, 11).

8. The safety switch as claimed in claim 1, wherein said mating surfaces (17*a*, 18*a*) are dihedral surfaces.

9. The safety switch as claimed in claim 8, wherein said dihedral surfaces (17*a*, 18*a*) define an edge parallel to said oscillation axis (O—O).

10. The safety switch as claimed in claim 8, wherein said dihedral surfaces (17*a*, 18*a*) define an edge oriented in a transverse direction relative to said oscillation axis (O—O).

11. The safety switch as claimed in claim 10, wherein the orientation direction of said edge is inclined at an angle included between +30° and −30° relative to said oscillation axis (O—O).

12. The safety switch as claimed in claim 10, wherein the orientation direction of the edge lies in a plane containing said oscillation axis (O—O).

13. The safety switch as claimed in claim 1, wherein said electric terminals (6, 7, 9) radially project from the casing (1) floor inwardly over a different height, the contact point between said first terminal (7) and the corresponding contact-holding element (10) being disposed on the surface of the contact-holding element (10) facing the casing (1) floor, the contact point between said second terminal (9) and the corresponding contact-holding element (11) being disposed on the surface of the contact-holding element (11) facing said key (2).

14. The safety switch as claimed in claim 1, wherein said passive position corresponds to the contact between said first contact-holding element (10) and the corresponding first terminal (7).

* * * * *